US006951409B2

(12) United States Patent
Hsien

(10) Patent No.: US 6,951,409 B2
(45) Date of Patent: Oct. 4, 2005

(54) LAMP ASSEMBLY ATTACHED ON A HAND TOOL

(76) Inventor: Chih-Ching Hsien, 58, Ma Yuan West St., Taichung (TW)

( * ) Notice: Subject to any disclaimer, the term of this patent is extended or adjusted under 35 U.S.C. 154(b) by 50 days.

(21) Appl. No.: 10/652,432

(22) Filed: Aug. 29, 2003

(65) Prior Publication Data

US 2005/0047124 A1 Mar. 3, 2005

(51) Int. Cl.[7] ..... F21L 4/00

(52) U.S. Cl. ..... 362/191; 362/119; 362/398; 362/285

(58) Field of Search ..... 362/190–191, 362/119–120, 398, 253, 285

(56) References Cited

U.S. PATENT DOCUMENTS

| | | | | | |
|---|---|---|---|---|---|
| 3,739,167 | A | * | 6/1973 | Avery | 362/157 |
| 5,738,432 | A | * | 4/1998 | Okko et al. | 362/103 |
| 6,619,813 | B1 | * | 9/2003 | Schnell | 362/116 |
| 2002/0105797 | A1 | * | 8/2002 | Navid et al. | 362/120 |

* cited by examiner

*Primary Examiner*—Ali Alavi

(57) ABSTRACT

A lamp assembly includes a positioning seat, and an illumination device rotatably mounted on the positioning seat, so that an included angle between the illumination device and the positioning seat can be adjusted. Thus, the rotary body of the illumination device is rotated about the positioning body of the positioning seat, so that the illumination device can be rotated through 360 degrees so as to provide an illumination effect.

15 Claims, 14 Drawing Sheets

LAMP ASSEMBLY ATTACHED ON A HAND TOOL

BACKGROUND OF THE INVENTION

1. Field of the Invention

The present invention relates to a lamp assembly, and more particularly to a lamp assembly that can be attached on a hand tool, such as a wrench, a screwdriver or the like, thereby providing an illumination effect.

2. Description of the Related Art

A conventional hand tool, such as a wrench, a screwdriver or the like, can be used to operate a workpiece, such as a nut, bolt or the like. However, when the workpiece is located at a deeper or darker site, the user needs to hold a flashlight to provide an illumination effect during operation of the hand tool, thereby causing inconvenience to the user.

SUMMARY OF THE INVENTION

The primary objective of the present invention is to provide a lamp assembly that can be attached on a hand tool, such as a wrench, a screwdriver or the like, thereby providing an illumination effect.

Another objective of the present invention is to provide a lamp assembly, wherein the rotary body of the illumination device is swiveled about the positioning body of the positioning seat in a horizontal manner, so that the illumination device can be swiveled horizontally through 360 degrees so as to provide a horizontal illumination effect.

A further objective of the present invention is to provide a lamp assembly, wherein the rotary body of the illumination device is rotated about the positioning body of the positioning seat vertically, so that the illumination device can be rotated vertically so as to provide a vertical illumination effect.

A further objective of the present invention is to provide a lamp assembly that can be assembled and dismantled easily and conveniently.

A further objective of the present invention is to provide a lamp assembly, wherein the locking strip of the illumination device can be rotated with the rotary body and can be inserted into and locked in the locking groove of the positioning body.

In accordance with the present invention, there is provided a lamp assembly, comprising:

a positioning seat; and an illumination device rotatably mounted on the positioning seat, so that an included angle between the illumination device and the positioning seat can be adjusted.

In addition, the positioning seat includes a positioning body having an inside formed with a receiving recess, and the illumination device includes a rotary body rotatably mounted in the receiving recess of the positioning body.

Further benefits and advantages of the present invention will become apparent after a careful reading of the detailed description with appropriate reference to the accompanying drawings.

DETAILED DESCRIPTION OF THE INVENTION

Figure 1:
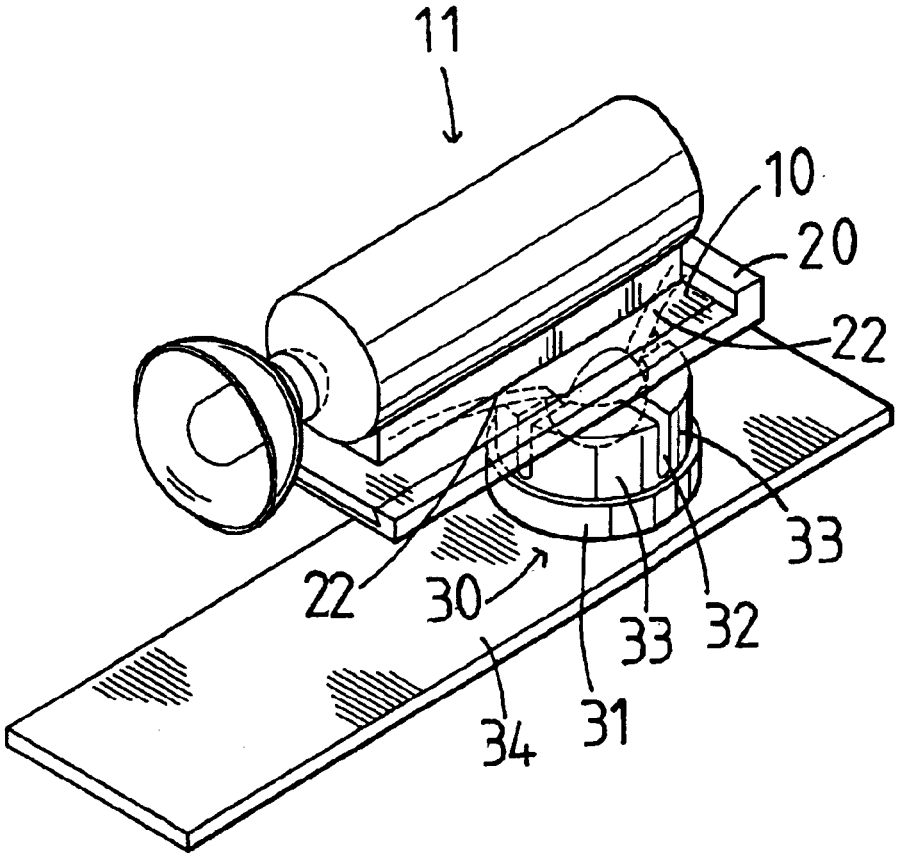
FIG. 1 is a perspective view of a lamp assembly in accordance with the preferred embodiment of the present invention.
Figure 2:
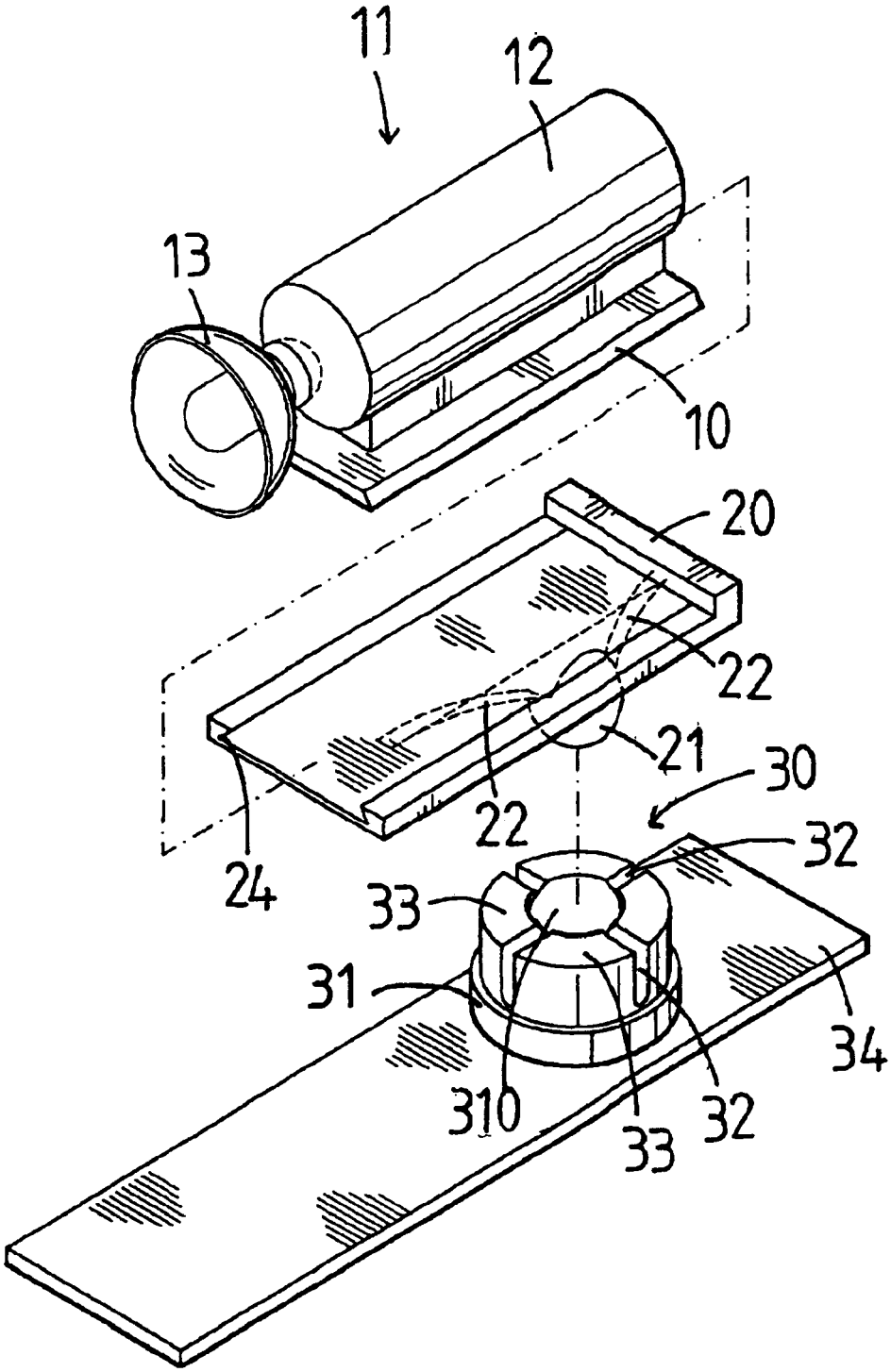
FIG. 2 is an exploded perspective view of the lamp assembly as shown in FIG. 1.

Referring to the drawings and initially to FIGS. 1–6, a lamp assembly in accordance with the preferred embodiment of the present invention comprises a positioning seat 30, and an illumination device 11 rotatably mounted on the positioning seat 30, so that an included angle between the illumination device 11 and the positioning seat 30 can be adjusted arbitrarily.

The positioning seat 30 includes a positioning body 31, and an attachment board 34 mounted on a lower end of the positioning body 31. Preferably, the attachment board 34 of the positioning seat 30 has a flat shape. The positioning body 31 of the positioning seat 30 has an inside formed with a receiving recess 310 and has a periphery formed with a cross-shaped locking groove 32 which form a plurality of elastic locking blocks 33. The positioning seat 30 further includes a magnetic body 35 (see FIG. 3) mounted between the positioning body 31 and the attachment board 34.

The illumination device 11 includes a rotary body 21 rotatably mounted in the receiving recess 310 of the positioning body 31, a wedge-shaped locking strip 22 secured on a top of the rotary body 21, a positioning board 20 secured on the locking strip 22, a support plate 10 secured on the positioning board 20, and a housing 12 secured on the support plate 10.

The rotary body 21 of the illumination device 11 is clamped by the locking blocks 33 of the positioning body 31 in an elastic manner.

The locking strip 22 of the illumination device 11 can be rotated with the rotary body 21 and can be inserted into and locked in the locking groove 32 of the positioning body 31.

The positioning board 20 of the illumination device 11 is formed with a dovetailed groove 24, and the support plate 10 has a dovetailed shape, so that the support plate 10 is secured in the dovetailed groove 24 of the positioning board 20.

Figure 5:
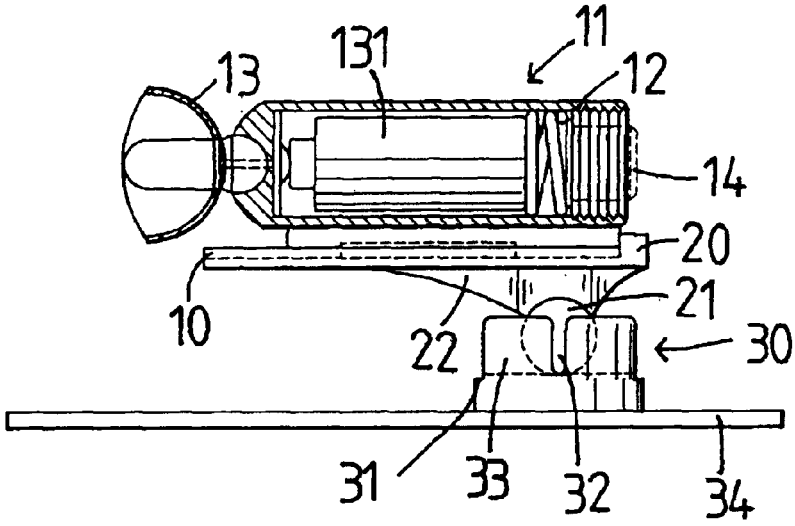
FIG. 5 is a plan cross-sectional view of the lamp assembly as shown in FIG. 1.

The housing 12 of the illumination device 11 is provided with a bulb 13, a battery 131 (see FIG. 5), and a switch 14 (see FIG. 5).

Figures 3, 4:
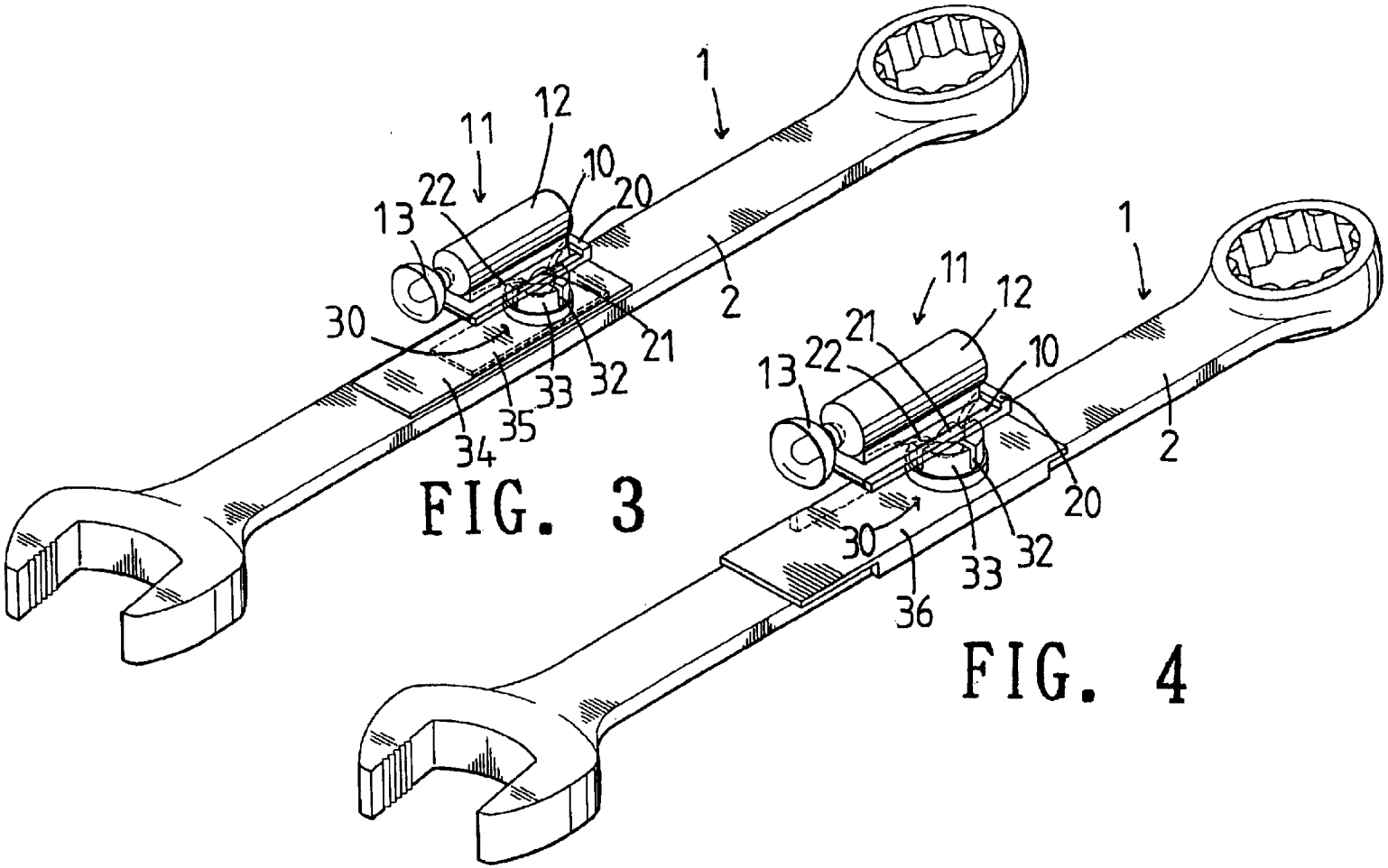
FIG. 3 is a perspective assembly view of the lamp assembly and a wrench in accordance with the preferred embodiment of the present invention.
FIG. 4 is a perspective assembly view of the lamp assembly and a wrench in accordance with another embodiment of the present invention.

As shown in FIG. 3, the attachment board 34 of the positioning seat 30 is attached on the handle 2 of a hand tool, such as a wrench 1 by the magnetic attraction effect of the magnetic body 35.

As shown in FIG. 4, the attachment board 34 of the positioning seat 30 is substantially inverted U-shaped and is rested on the two sides of the handle 2 of the wrench 1, so that the attachment board 34 of the positioning seat 30 is movable on the handle 2 of the wrench 1.

Figure 6:
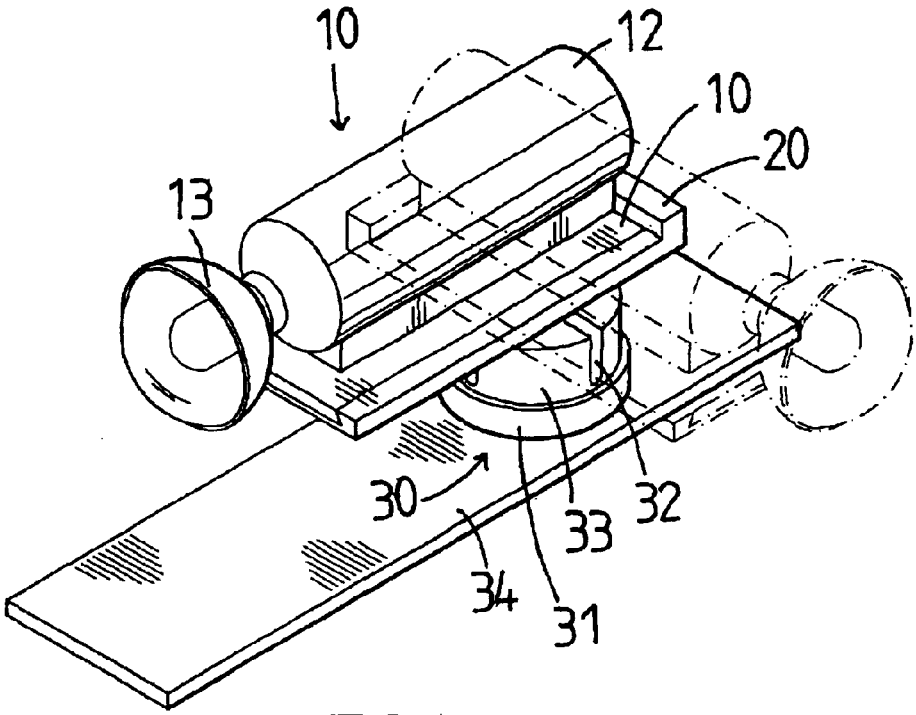
FIG. 6 is a schematic operational view of the lamp assembly as shown in FIG. 1 in use.
Figure 7:
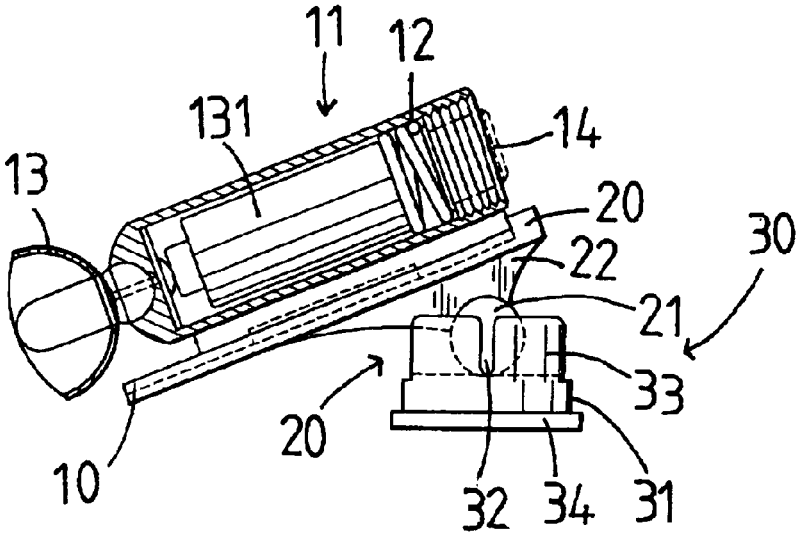
FIG. 7 is a schematic operational view of the lamp assembly as shown in FIG. 5 in use.
Figure 8:
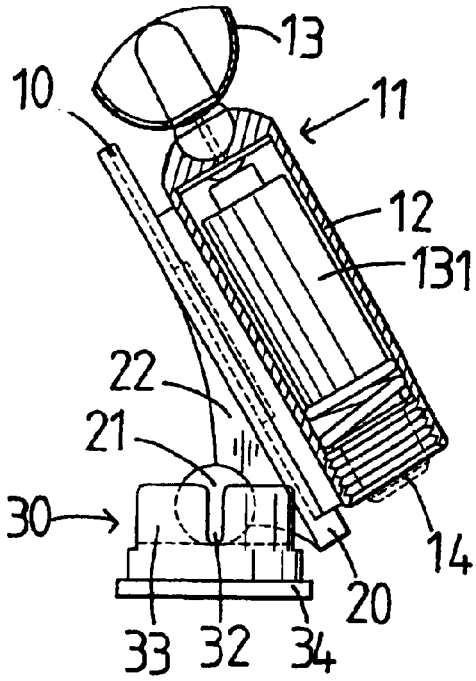
FIG. 8 is a schematic operational view of the lamp assembly as shown in FIG. 5 in use.
Figure 9:
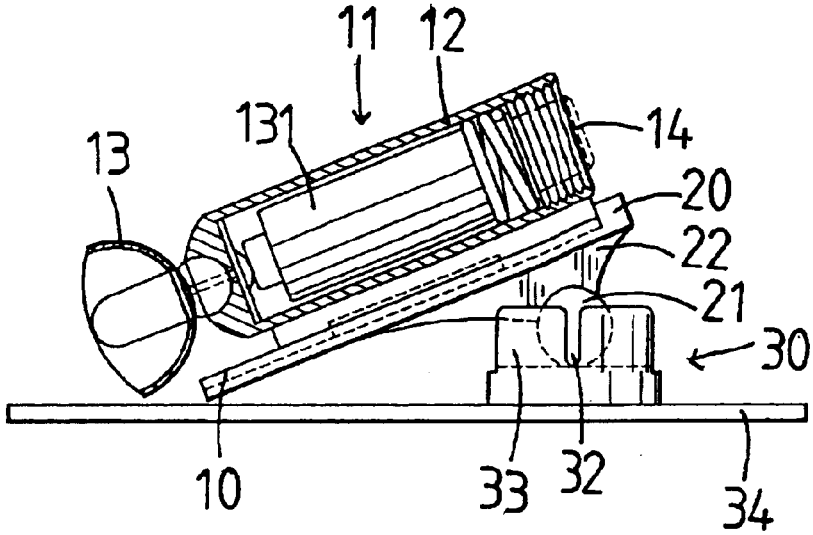
FIG. 9 is a schematic operational view of the lamp assembly as shown in FIG. 5 in use.
Figure 10:
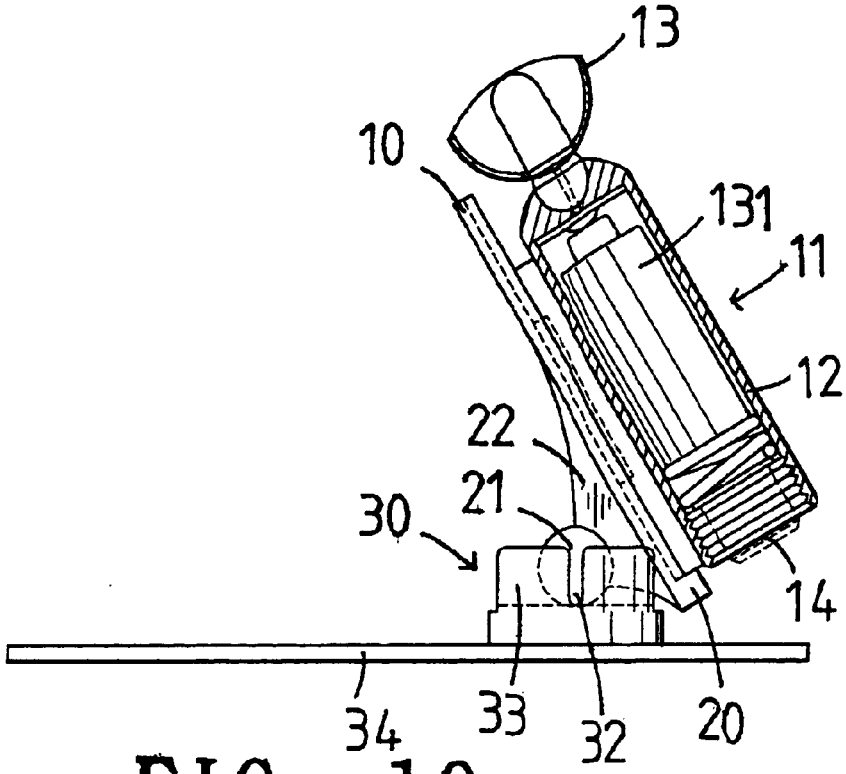
FIG. 10 is a schematic operational view of the lamp assembly as shown in FIG. 5 in use.

As shown in FIGS. 5 and 6, the rotary body 21 of the illumination device 11 is swiveled about the positioning body 31 of the positioning seat 30 horizontally, so that the illumination device 11 can be swiveled horizontally through 360 degrees so as to provide a horizontal illumination effect.

As shown in FIGS. 7–10, the rotary body 21 of the illumination device 11 is rotated about the positioning body 31 of the positioning seat 30 vertically, so that the illumination device 11 can be rotated vertically so as to provide a vertical illumination effect. In addition, the locking strip 22 of the illumination device 11 can be rotated with the rotary body 21 and can be inserted into and locked in the locking groove 32 of the positioning body 31.

Figure 11:
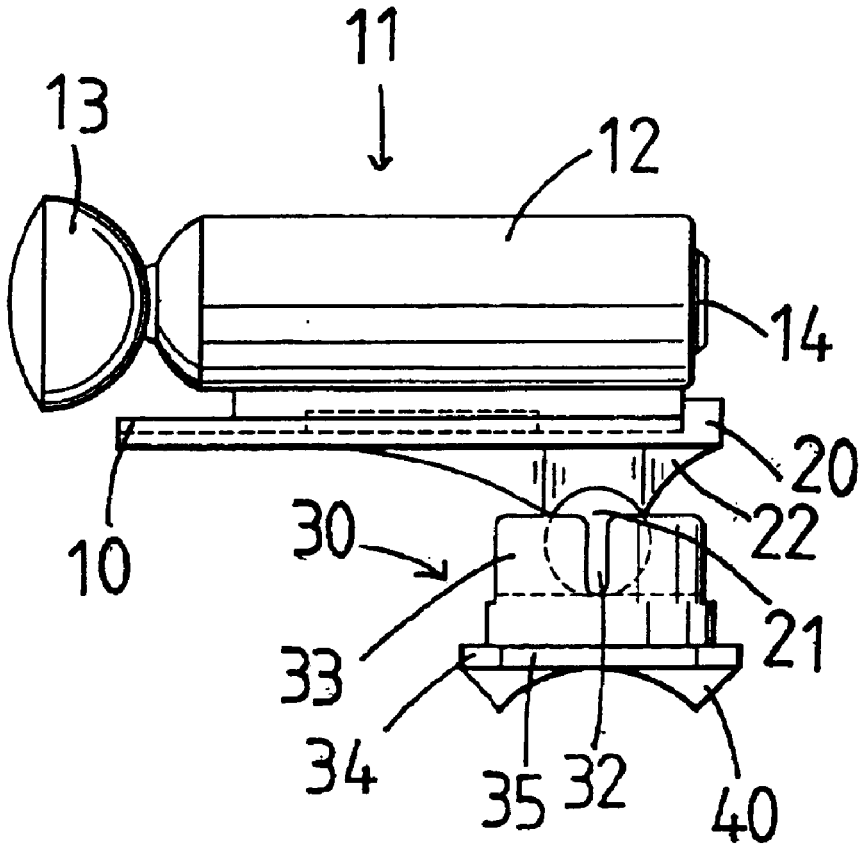
FIG. 11 is a plan view of a lamp assembly in accordance with another embodiment of the present invention.

Referring to FIG. 11, the attachment board 34 of the positioning seat 30 has a bottom formed with an arcuate locking body 40 that can be mounted on a circular handle. In addition, the magnetic body 35 is mounted between the attachment board 34 and the arcuate locking body 40.

Figure 12:
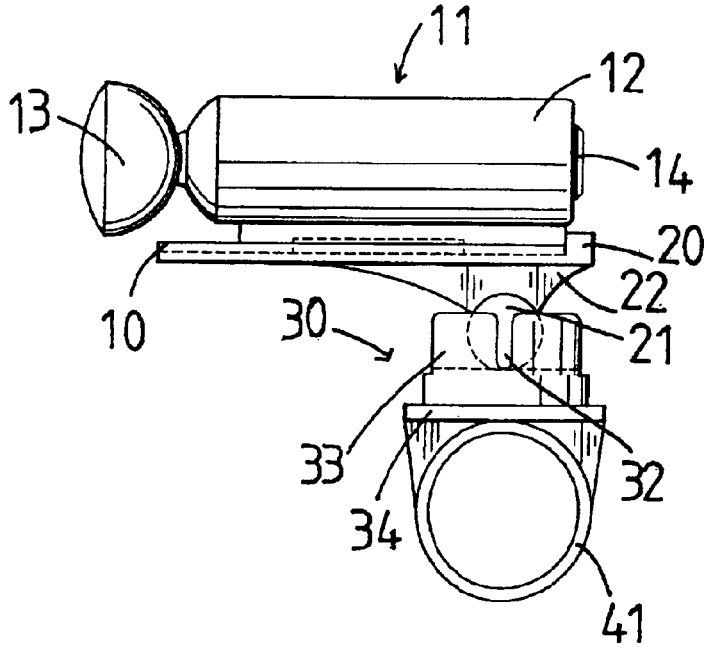
FIG. 12 is a plan view of a lamp assembly in accordance with another embodiment of the present invention.
Figure 13:
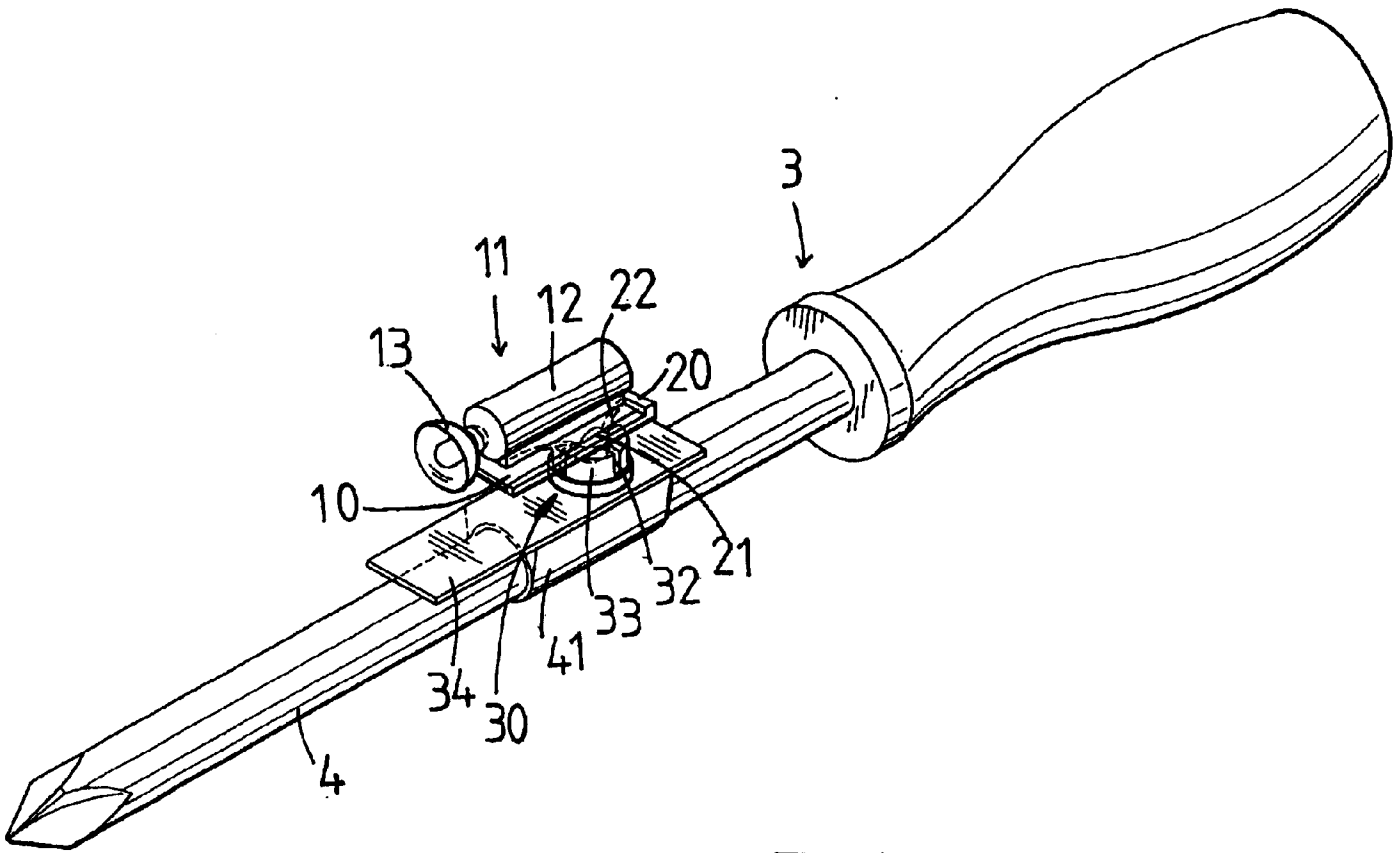
FIG. 13 is a perspective assembly view of the lamp assembly and a screwdriver as shown in FIG. 12.

Referring to FIGS. 12 and 13, the attachment board 34 of the positioning seat 30 has a bottom formed with a circular mounting body 41 that can be mounted on the circular shank 4 of a screwdriver 3.

Figure 14:
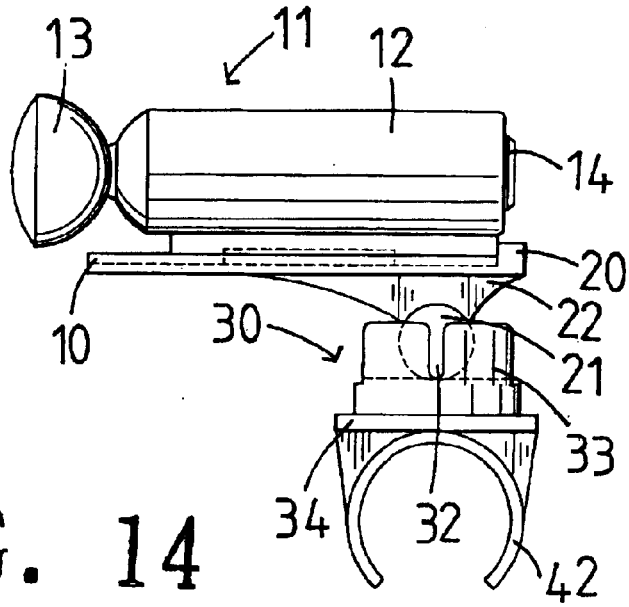
FIG. 14 is a plan view of a lamp assembly in accordance with another embodiment of the present invention.

Referring to FIG. 14, the attachment board 34 of the positioning seat 30 has a bottom formed with a substantially C-shaped elastic mounting body 42 that can be mounted on the circular shank of a screwdriver.

Figure 15:
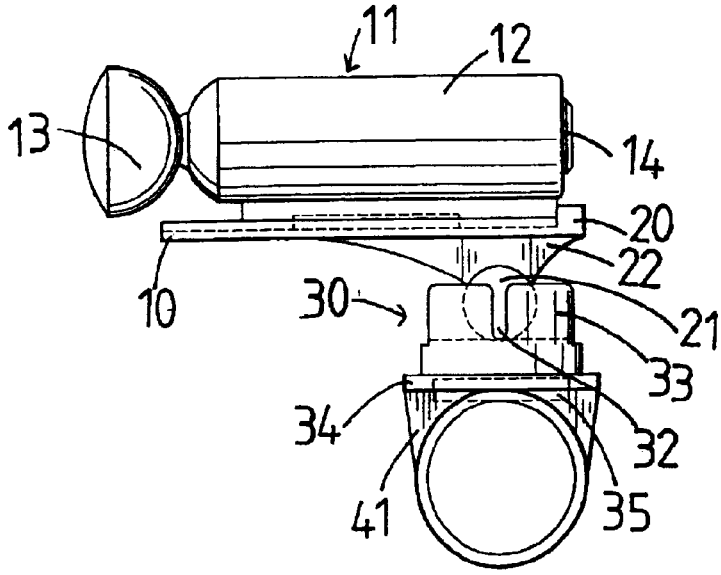
FIG. 15 is a plan view of a lamp assembly in accordance with another embodiment of the present invention.

Referring to FIG. 15, the magnetic body 35 is mounted between the attachment board 34 and the circular mounting body 41.

Figure 16:
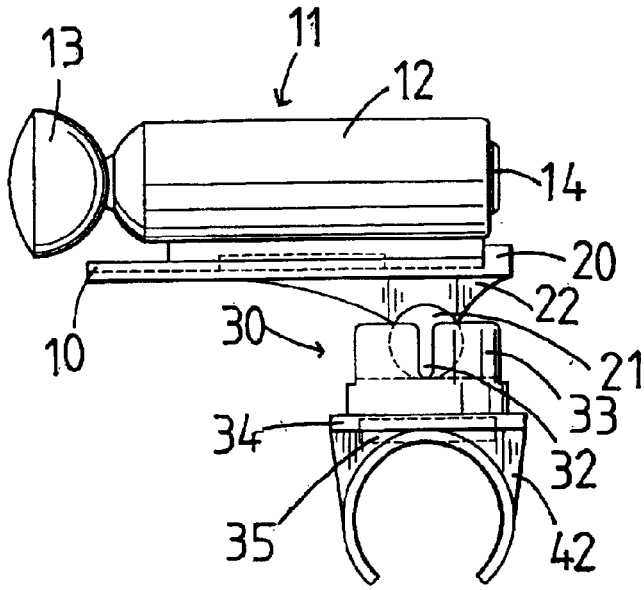
FIG. 16 is a plan view of a lamp assembly in accordance with another embodiment of the present invention.

Referring to FIG. 16, the magnetic body 35 is mounted between the attachment board 34 and the elastic mounting body 42.

Figure 18:
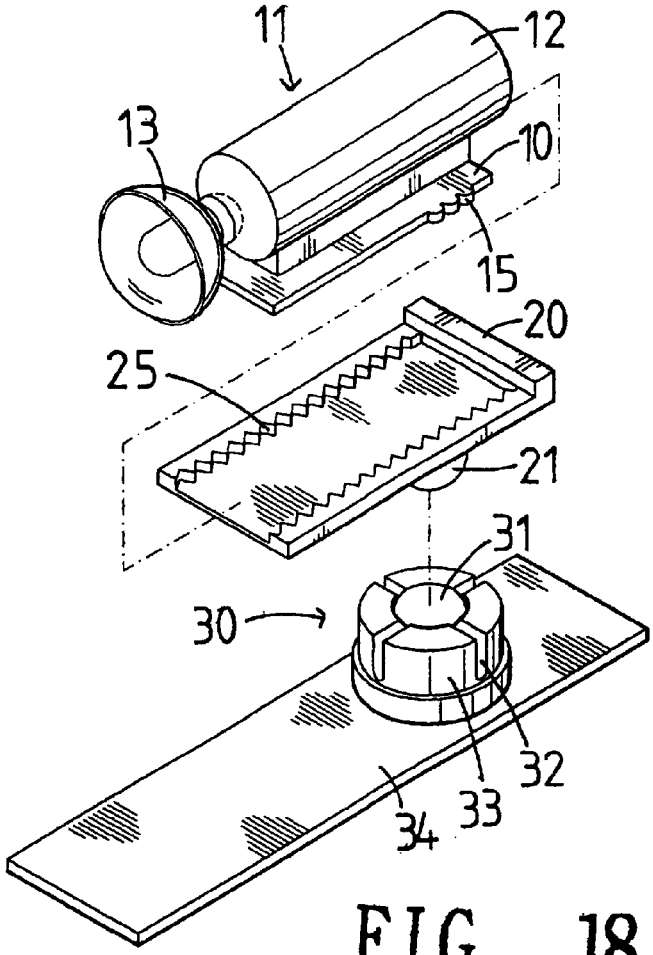
FIG. 18 is an exploded perspective view of the lamp assembly as shown in FIG. 17.
Figure 17:
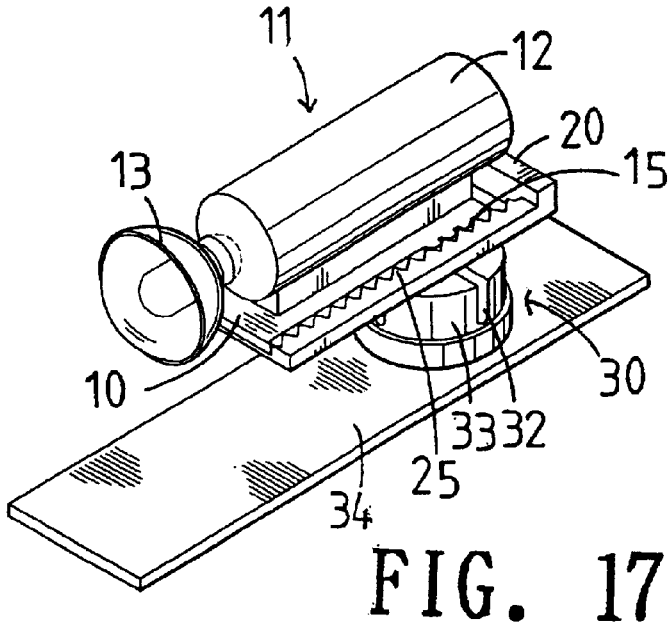
FIG. 17 is a perspective view of a lamp assembly in accordance with another embodiment of the present invention.

Referring to FIGS. 17 and 18, the positioning board 20 of the illumination device 11 has two sides each provided with a plurality of locking teeth 25, and the support plate 10 has two sides each provided with a plurality of engaging teeth 15 engaged with the locking teeth 25 of the positioning board 20, so that the support plate 10 is secured on the positioning board 20.

Figure 19:
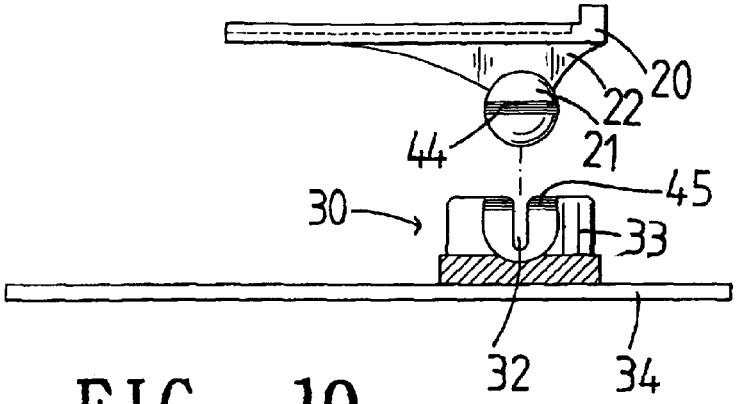
FIG. 19 is a plan exploded cross-sectional view of a lamp assembly in accordance with another embodiment of the present invention.
Figure 20:
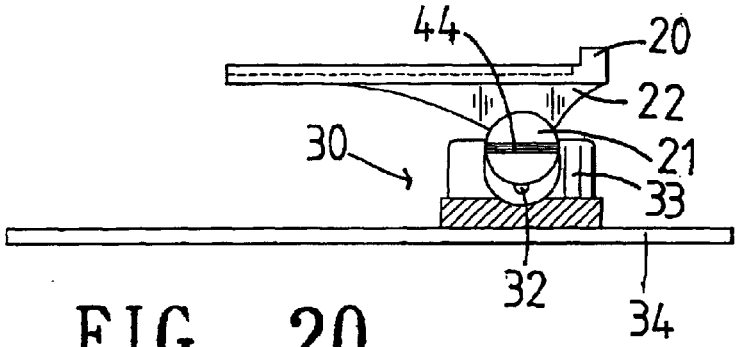
FIG. 20 is a plan assembly view of the lamp assembly as shown in FIG. 19.
Figure 21:
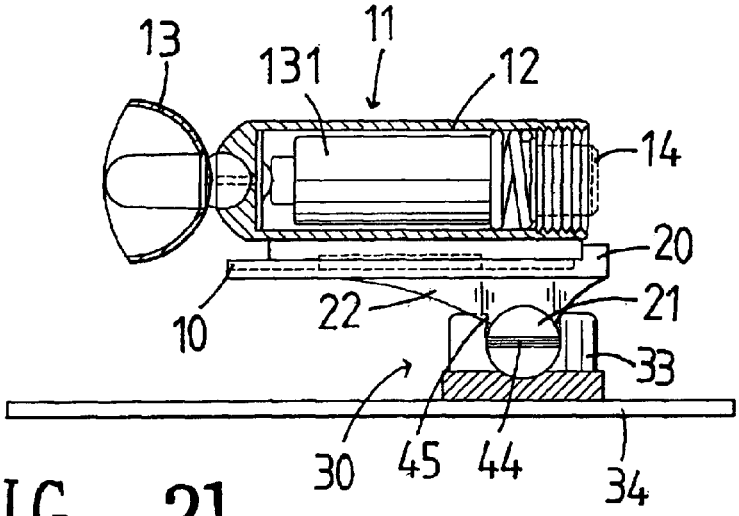
FIG. 21 is a plan assembly view of the lamp assembly as shown in FIG. 20.

Referring to FIGS. 19–21, each of the locking blocks 33 of the positioning seat 30 has an inner wall formed with an inner thread 45, and the rotary body 21 of the illumination device 11 has a periphery formed with an outer thread 44 screwed into the inner thread 45 of each of the locking blocks 33 of the positioning seat 30, so that the rotary body 21 of the illumination device 11 is retained on the positioning seat 30 without detachment.

Figure 22:
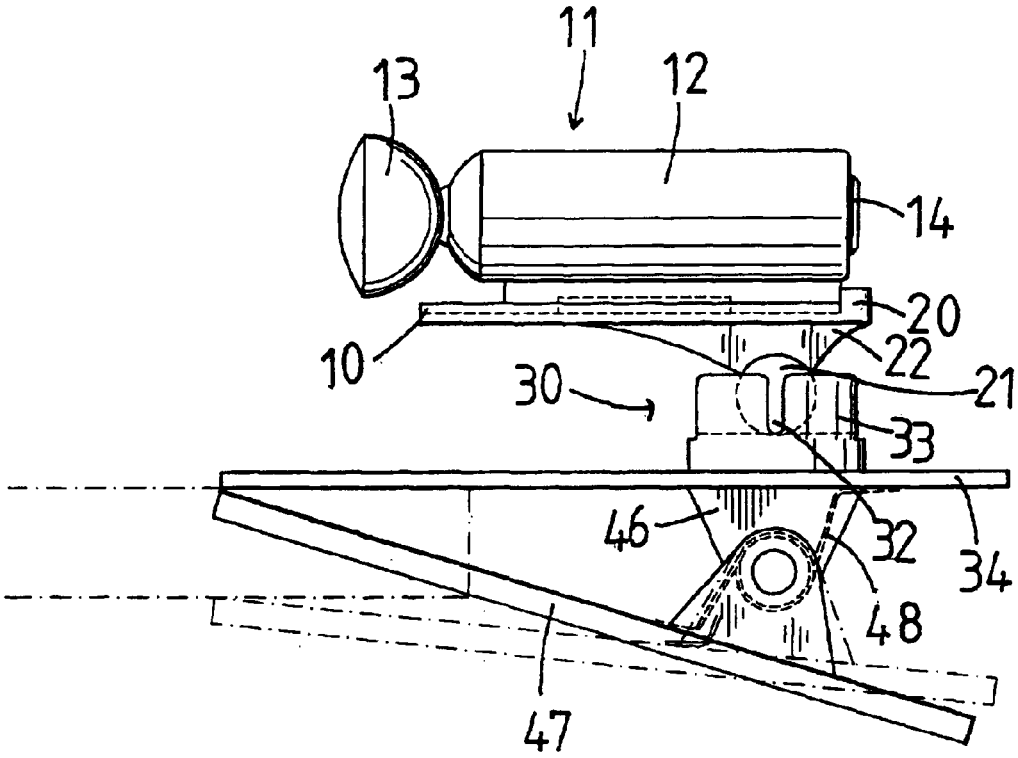
FIG. 22 is a plan view of a lamp assembly in accordance with another embodiment of the present invention.

Referring to FIG. 22, the attachment board 34 of the positioning seat 30 has a bottom provided with a pivot portion 46, and the positioning seat 30 further includes a clamping body 47 pivotally mounted on the pivot portion 46, and a torsion spring 48 urged between the pivot portion 46 and the clamping body 47. Thus, the positioning seat 30 can be attached on a user's waist belt.

Figure 23:
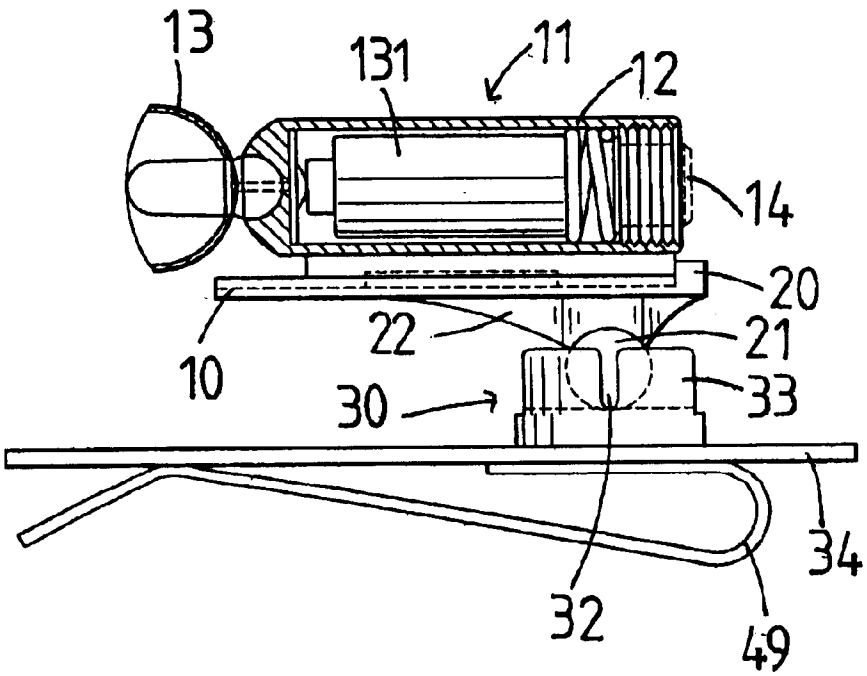
FIG. 23 is a plan cross-sectional view of a lamp assembly in accordance with another embodiment of the present invention.

Referring to FIG. 23, the attachment board 34 of the positioning seat 30 has a bottom provided with an elastic clip 49, so that the positioning seat 30 can be attached on a user's waist belt.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A lamp assembly, comprising:

a positioning seat; and an illumination device rotatably mounted on the positioning seat, so that an angle between the illumination device and the positioning seat can be adjusted; wherein the positioning seat includes a positioning body having an inside formed with a receiving recess, and the illumination device includes a rotary body rotatably mounted in the receiving recess of the positioning body;

the positioning body has a periphery formed with a cross-shaped locking groove provided with a plurality of elastic locking blocks for clamping the rotary body in an elastic manner;

the illumination device further includes wedge-shaped locking strip secured on a top of the rotary body, and the locking strip of the illumination device can be rotated with the rotary body and can be inserted into and locked in the locking groove of the positioning body;

the illumination device further includes a positioning board secured on the locking strip, a support plate secured on the positioning board, and a housing secured on the support plate;

the positioning board of the illumination device has two sides each provided with a plurality of locking teeth, and the support plate has two sides each provided with a plurality of engaging teeth engaged with the locking teeth of the positioning board, so that the support plate is secured on the positioning board.

2. The lamp assembly in accordance with claim 1, wherein the positioning board of the illumination device is formed with a dovetailed groove, and the support plate has a dovetailed shape, so that the support plate is secured in the dovetailed groove of the positioning board.

3. The lamp assembly in accordance with claim 1, wherein the housing of the illumination device is provided with a bulb, a battery, and a switch.

4. The lamp assembly in accordance with claim 1, wherein the positioning seat further includes an attachment board mounted on a lower end of the positioning body.

5. The lamp assembly in accordance with claim 4, wherein the positioning seat further includes a magnetic body mounted between the positioning body and the attachment board.

6. The lamp assembly in accordance with claim 4, wherein the attachment board of the positioning seat has a bottom formed with an arcuate locking body.

7. The lamp assembly in accordance with claim 6, wherein the positioning seat further includes a magnetic body mounted between the attachment board and the arcuate locking body.

8. The lamp assembly in accordance with claim 4, wherein the attachment board of the positioning seat has a bottom formed with a circular mounting body.

9. The lamp assembly in accordance with claim 8, wherein the positioning seat further includes a magnetic body mounted between the attachment board and the circular mounting body.

10. The lamp assembly in accordance with claim 4, wherein the attachment board of the positioning seat has a bottom formed with a C-shaped elastic mounting body.

11. The lamp assembly in accordance with claim 10, wherein the positioning seat further includes a magnetic body mounted between the attachment board and the elastic mounting body.

12. A lamp assembly, comprising:

a positioning seat; and an illumination device rotatably mounted on the positioning seat, so that an angle between the illumination device and the positioning seat can be adjusted; wherein the positioning seat includes a positioning body having an inside with a receiving recess, and the illumination device includes a rotary body rotatably mounted in the receiving recess of the positioning body;

the positioning body has a periphery formed with a cross-shaped locking groove provided with a plurality of elastic locking blocks for clamping the rotary body in an elastic manner;

each of the locking blocks of the positioning seat has an inner wall formed with an inner thread, and the rotary body of the illumination device has a periphery formed with an outer thread screwed into the inner thread of each of the locking blocks of the positioning seat.

13. The lamp assembly in accordance with claim 4, wherein the attachment board of the positioning seat has a bottom provided with a pivot portion, and the positioning seat further includes a clamping body pivotally mounted on the pivot portion, and a torsion spring urged between the pivot portion and the clamping body.

14. The lamp assembly in accordance with claim 4, wherein the attachment board of the positioning seat has a bottom provided with an elastic clip.

15. The lamp assembly in accordance with claim 4, wherein the attachment board of the positioning seat is substantially inverted U-shaped.

* * * * *